US006139999A

United States Patent [19]

Fuller et al.

[11] Patent Number: 6,139,999

[45] Date of Patent: Oct. 31, 2000

[54] IMAGING MEMBER WITH PARTIALLY CONDUCTIVE OVERCOATING

[75] Inventors: Timothy J. Fuller, Pittsford; Damodar M. Pai, Fairport; John F. Yanus, Webster; Paul J. DeFeo, Sodus Point; Anthony T. Ward, Webster; Dale S. Renfer, Webster; Harold F. Hammond, Webster; Merlin E. Scharfe, Penfield; Markus R. Silvestri, Fairport; William W. Limburg, Penfield, all of N.Y.

[73] Assignee: Xerox Corporation, Stamford, Conn.

[21] Appl. No.: 09/429,387

[22] Filed: Oct. 28, 1999

[51] Int. Cl.[7] ..... G03G 5/147

[52] U.S. Cl. ..... 430/58.65; 430/58.75; 430/58.8; 430/59.6; 430/66; 430/31; 430/124

[58] Field of Search ..... 430/58.65, 59.6, 430/66, 58.75, 58.8, 31, 124

[56] References Cited

U.S. PATENT DOCUMENTS

| | | | |
|---|---|---|---|
| 4,426,435 | 1/1984 | Oka | 430/132 |
| 4,515,882 | 5/1985 | Mammino et al. | 430/58 |
| 5,215,841 | 6/1993 | Scarfe et al. | 430/58.65 |
| 5,368,967 | 11/1994 | Schank et al. | 430/59 |
| 5,681,679 | 10/1997 | Schank et al. | 430/59 |
| 5,702,854 | 12/1997 | Schank et al. | 430/59 |
| 5,709,974 | 1/1998 | Yuh et al. | 430/59 |
| 6,071,659 | 6/2000 | Renfer et al. | 430/59.6 |

*Primary Examiner*—Christopher D. RoDee

[57] ABSTRACT

An electrophotographic imaging member including at least one photographic imaging layer and a partially electrically conductive overcoat layer including finely divided charge injection enabling particles dispersed in a charge transporting continuous matrix including a cross linked polyamide, charge transport molecules and oxidized charge transport molecules, the continuous matrix being formed from a solution selected from the group including a first solution including crosslinkable alcohol soluble polyamide containing methoxy methyl groups attached to amide nitrogen atoms, an acid having a $pK_a$ of less than about 3, a cross linking agent selected from the group comprising a formaldehyde generating cross linking agent, an alkoxylated cross linking agent, a methylolamine cross linking agent and mixtures thereof, a dihydroxy arylamine, and a liquid selected from the group including alcohol solvents, diluent and mixtures thereof, a second solution including crosslinkable alcohol soluble polyamide free of methoxy methyl groups attached to amide nitrogen atoms, an acid having a $pK_a$ of less than about 3, an alkoxylated cross linking agent, a methylolamine cross linking agent and mixtures thereof, a dihydroxy arylamine, and a liquid selected from the group including alcohol solvents, diluent and mixtures thereof.

The electrophotographic imaging process is also disclosed.

21 Claims, 2 Drawing Sheets

IMAGING MEMBER WITH PARTIALLY CONDUCTIVE OVERCOATING

BACKGROUND OF THE INVENTION

This invention relates to electrophotography and more particularly, to an improved overcoated electrophotographic imaging member and method of using the electrophotographic imaging member.

Generally, electrophotographic imaging processes involve the formation and development of electrostatic latent images on the imaging surface of a photoconductive member. The photoconductive member is usually imaged by uniformly electrostatically charging the imaging surface in the dark and exposing the member to a pattern of activating electromagnetic radiation such as light, to selectively dissipate the charge in the illuminated areas of the member to form an electrostatic latent image on the imaging surface. The electrostatic latent image is then developed with a developer composition containing toner particles which are attracted to the photoconductive member in image configuration. The resulting toner image is often transferred to a suitable receiving member such as paper.

The photoconductive members include single or multiple layered devices comprising homogeneous or heterogeneous inorganic or organic compositions and the like. One example of a photoconductive member containing a heterogeneous composition is described in U.S. Pat. No. 3,121,006 wherein finely divided particles of a photoconductive inorganic compound is dispersed in an electrically insulating organic resin binder. The commercial embodiment usually comprises a paper backing containing a coating thereon of a binder layer comprising particles of zinc oxide uniformly dispersed therein. Useful binder materials disclosed therein include those which are incapable of transporting for any significant distance injected charge carriers generated by the photoconductive particles. Thus, the photoconductive particles must be in substantially contiguous particle to particle contact throughout the layer for the purpose of permitting charge dissipation required for cyclic operation. Thus, about 50 percent by volume of photoconductive particles is usually necessary in order to obtain sufficient photoconductive particle to particle contact for rapid discharge. These relatively high photoconductive concentrations can adversely affect the physical continuity of resin binder and can significantly reduce the mechanical strength of the binder layer.

Other known photoconductive compositions include amorphous selenium, halogen doped amorphous selenium, amorphs including selenium arsenic, selenium tellurium, selenium arsenic antimony doped selenium alloys, cadmium sulfide and the like. Generally, these inorganic photoconductive materials are deposited as a relatively homogeneous layer on suitable conductive substrates. Some of these inorganic layers tend to crystallize when exposed to certain vapors that may occasionally be found in the ambient atmosphere. Moreover, the surfaces of selenium type photoreceptors are highly susceptible to scratches which print out in final copies.

Still other electrophotographic imaging members known in the art comprise a conductive substrate having deposited thereon an organic photoconductor such as a polyvinylcarbazole-2,4,7-trinitrofluorenone combination, phthalocyanines, quinacridones, pyrazolones and the like. Some of these photoreceptors, such as those containing 2,4,7-trinitrofluorenone, present health or safety issues Recently, there has been disclosed layered photoresponsive devices comprising photogenerating layers and transport layers deposited on conductive substrates as described, for example, in U.S. Pat. No. 4,265,990 and overcoated photoresponsive materials containing a hole injecting layer, a hole transport layer, a photogenerating layer and a top coating of an insulating organic resin, as described, for example, in U.S. Pat. No. 4,251,612. Examples of photogenerating layers disclosed in these patents include trigonal selenium and various phthalocyanines and hole transport layers containing certain diamines dispersed in inactive polycarbonate resin materials. The disclosures of each of these patents, namely, U.S. Pat. No. 4,265,990 and U.S. Pat. No. 4,251,612 are incorporated herein by reference in their entirety. Other representative patents containing layered photoresponsive devices include U.S. Pat. No. 3,041,116; U.S. Pat. No. 4,115,116; U.S. Pat. No. 4,047,949 and U.S. Pat. No. 4,081,274. These patents relate to systems that require negative charging for hole transporting layers when the photogenerating layer is beneath the transport layer. Photogenerating layers overlying hole transport layers require positive charging but must be equal to or less than about 1 to 2 micrometers for adequate sensitivity and therefore wear away quite rapidly.

While the above described electrophotographic imaging members may be suitable for their intended purposes, there continues to be a need for improved devices. For example, the imaging surface of many photoconductive members is sensitive to wear, ambient fumes, scratches and deposits which adversely affect the electrophotographic properties of the imaging member.

Also, in multilayered photoreceptors comprising a charge generating layer and a charge transport layer, wear of the transport layer during image cycling limits the life of small diameter organic photoreceptor drums employed in copiers, duplicators, printers, facsimile machines and the like. With the advent of Bias Charging Rolls (BCR),and Bias Transfer Rolls (BTR) the drum wear is catastrophic. Even with the gentlest of the Bias Charging Rolls, the wear is as much as 8 to 10 micrometers in 100 kilocycles of revolutions. With the small diameter drum and duty cycle considerations 100 kilocycles of revolution translates to as little as 10,000 to 20,000 prints. The machines employing these small diameter drums do not employ exposure control. Wear results in considerable reduction of sensitivity of the device. A drum life of 50,000 or more prints (one or million drum revolution cycles) is sorely needed.

Overcoating layers have been proposed to overcome the undesirable characteristics of uncoated photoreceptors. However, many of the overcoating layers adversely affect electrophotographic performance of an electrophotographic imaging member. One type of overcoating material that has been described in the prior art is electrically insulating. For example, an insulating overcoating containing an organic high polymer and Lewis acid is described in U.S. Pat. No. 4,225,648. This overcoating may also contain other additives such as pigment, dye and hardener. An insulating overcoating containing the combination of a resin and an organic aluminum compound is described in U.S. Pat. No. 3,966,471. Apparently, the organic aluminum compound reacts with the resin to promote transfer of toner images to the receiving member. In U.S. Pat. No. 4,191,568, an insulating overcoating containing a resin and certain electron donor compounds with or without electronic acceptor compounds are mentioned. When an electrically insulating overcoating layer is employed, the thickness must be quite thin to permit discharge of the photoreceptor during exposure to activating radiation and image configuration. Further, there is a tendency for a residual charge to remain on the surface of the insulating overcoating layer after exposure. The residual voltage level intensifies as the thickness of the insulating coating is increased. This causes undesirably high background deposits in the final toner image. Moreover, scratches on imaging surfaces tend to be printed out due to the electrical differences between the scratched areas and the unscratched areas. Attempts have been made to minimize these problems by making the insulating coating as thin as possible. However, thin coatings are difficult to uniformly deposit and are subject to rapid wear. As the overcoating wears and changes in thickness, the imaging characteristics of the photoreceptor also change since charge density is dependent upon thickness.

The electrophotographic industry is feverishly searching for a tough overcoat. One durable overcoat is a cross linked polyamide (e.g. Luckamide, available from Dai Nippon Ink) containing dihydroxy biphenyl diamine (DHTBD) and dihydroxy triphenyl methane (DHTPM), and employing oxalic acid for cross linking. Although, this composition exhibits excellent electrical and wear properties, the low charge carrier mobility of this overcoat limits the overcoat thickness to less than 3 micrometers. Overcoats of this material having a thickness greater than 3 micrometers results in a severe increase on the "tails" of Photo-Induced Discharge Curve (PIDC). This severe increase on the "tails" results in loss of contrast potentials. Contrast potential is the difference in potential of photoconductor regions exposed to dark regions of the print and those exposed to the white background regions of the print. Loss of contrast potential can result in lighter images or increase in density of the white background regions of the print. Moreover, the formulation of an overcoat composition that exhibits a lower wear rate is a formidable task because the overcoat must also transport holes (without trapping), be insensitive to moisture, and not redissolve the transport layer when the overcoating is applied.

Attempts have also been made to overcome the deficiencies of overcoating layers by employing overcoating material which is less insulating to prevent electric charge from accumulating on or in the overcoating layer. Conductive overcoatings have been disclosed containing aromatic diamines. For example, the aromatic diamine is combined with an organic halogen capable of producing a free halogen in U.S. Pat. No. 4,293,630. Examples of prior art additives used to render protective overcoatings conductive including carbon black, metal powder, tetra-ammonium salt and the like are mentioned in the introduction of U.S. Pat. No. 4,191,568. Conductive overcoatings containing a resin and metal oxide particles are revealed in U.S. Pat. No. 4,426,435. The protective layer may also be made less insulating by incorporating appropriate materials such as quaternary ammonium salts or the like in the overcoating layer. However, the conductivity of such materials varies greatly due to the absorption of ambient moisture. Moreover, under very dry conditions, the conductivity of this type of overcoating layer is reduced to the extent that charge will accumulate on the outer surface of the overcoating layer with the attendant adverse effects described above with respect to insulating layers. Under humid conditions, the charge migration tends to occur laterally resulting in blurred images.

An overcoating containing a charge transport layer formed from linoleic acid and ethylene diamine is taught in U.S. Pat. No. 3,713,820. Electron acceptor compounds may be added to form a charge transfer complex thereby increasing the coating conductivity. An overcoating containing a resin and a metallocene is taught in U.S. Pat. No. 4,315,980. It appears that at least some of the resins form a charge transfer complex with ferrocene. Moreover, an electron acceptor may also be added to the overcoating layer. Further, a thin intermediate layer may be provided below the protective layer to improve electrical characteristics. The overcoatings of U.S. Pat. No. 3,713,820 and U.S. Pat. No. 4,315,980 exhibit a change in electrical conductivity by reacting with corona generated oxidizing compounds formed during charging.

In still another overcoated photoreceptor described in U.S. Pat. No. 4,515,882, the overcoat comprises an insulating film forming continuous phase comprising charge transport molecules and finely divided charge injection enabling particles dispersed in the continuous phase. Since the charge carriers giving rise to conductivity in these overcoatings emanate from the injecting particles only, the concentration of the injection particles must be higher than if the homogeneous medium surrounding the particles is also made conducting.

While some of the above-described imaging members exhibit certain desirable properties such as protecting the surface of an underlying photoconductive layer, there continues to be a need for improved overcoating layers for protecting electrophotographic imaging members.

INFORMATION DISCLOSURE STATEMENT

U.S. Pat. No. 4,515,882 issued to Mamino et al. On May 7, 1985.—An electrophotographic imaging system is disclosed utilizing a member comprising at least one photoconductive layer and an overcoating layer comprising a film forming continuous phase comprising charge transport molecules and finely divided charge injection enabling particles dispersed in the continuous phase, the insulating overcoating layer being substantially transparent to activating radiation to which the photoconductive layer is sensitive and substantially electrically insulating at low electrical fields.

U.S. Pat. No. 5,702,854 issued to Schank et al. on Dec. 30, 1997—An electrophotographic imaging member is disclosed including a supporting substrate coated with at least a charge generating layer, a charge transport layer and an overcoating layer, is said overcoating layer comprising a dihydroxy arylamine dissolved or molecularly dispersed in a cross linked polyamide matrix. The overcoating layer is formed by cross linking a cross linkable coating composition including a polyamide containing methoxy methyl groups attached to amide nitrogen atoms, a cross linking catalyst and a dihydroxy amine, and heating the coating to cross link the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,368,967 issued to Schank et al. on Nov. 29, 1994—An electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process.

U.S. Pat. No. 5,709,974 issued to Yuh et al. on Jan. 20, 1998—An electrophotographic imaging member is disclosed including a charge generating layer, a charge transport layer and an overcoating layer, the transport layer including a charge transporting aromatic diamine molecule in a polystyrene matrix and the overcoating layer including a hole transporting hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

U.S. Pat. No. 5,681,679 issued to Schank et al on Oct. 28, 1997—A flexible electrophotographic imaging member is disclosed including a supporting substrate and a resilient combination of at least one photoconductive layer and an overcoating layer, at least one photoconductive layer comprising a hole transporting arylamine siloxane polymer and the overcoating comprising a cross linked polyamide doped with a dihydroxy amine. This imaging member may be utilized in an imaging process including the formation of an electrostatic latent image on the imaging member, depositing toner particles on the imaging member in conformance with the latent image to form a toner image, and transferring the toner image to a receiving member.

U.S. Pat. No. 4,426,435 issued to Oka on Jan. 17, 1984—An electrophotographic light-sensitive member is disclosed comprising a conductive support, a photoconductive layer and a protective outer layer, the protective outer layer comprising at least one particulate metal oxide having a mean particle size below about 0.3 um dispersed in an organic resin binder material. The electrophotographic light-sensitive member may be prepared by initially forming the protective outer layer and thereafter applying the photoconductive layer and conductive support thereto.

CROSS REFERENCE TO COPENDING APPLICATIONS

U.S. application Ser. No. 09/218,409 allowed entitled Novel Cross Linked Conducting Compositions, filed in the names of T. Fuller et al. on Dec. 22, 1998—Described is a conductive composition including a mixture of a reaction product of a hole transporting hydroxy functionalized aryl amine, a hydroxy functionalized arylamine that is different from the hole transporting hydroxy functionalized aryl amine, a cross linkable polyamide, and an acid capable of simultaneously cross linking the polyamide and oxidizing a portion of the hydroxy functionalized arylamine, the mixture of a reaction product including a hole transporting hydroxy functionalized aryl amine and an oxidized hydroxy functionalized aryl amine in a crosslinked polyamide matrix. Other embodiments including processes for applying the aforementioned composition and processes for using devices containing the compositions in high speed laser printing and related printing systems are also disclosed.

U.S. application Ser. No. 09/429,378 now U.S. Pat. No. 6,096,470 entitled Electrophotographic Imaging Member Overcoat Fabrication Process, filed in the names of T. Fuller et al. concurrently herewith—Described is a process for fabricating an electrophotographic imaging member including forming a charge generating layer, forming an undried charge transport layer coating by applying to the charge generating layer a solution selected from the group consisting of a solution including a charge transport molecule, a first film forming binder and at least a first solvent and a solution including a charge transporting polymer and at least a first solvent, forming an undried overcoat layer coating by applying to the undried charge transport layer coating an overcoat layer coating solution including a second film forming polymer and at least a second solvent, the charge transport molecule and first film forming polymer and charge transporting polymer being substantially insoluble in the second solvent and the second polymer being substantially insoluble in the first solvent, applying heat to both the undried charge transport layer coating and the undried overcoat layer coating to migrate the first solvent from the charge transport layer coating through the undried overcoat layer coating while maintaining the overcoat layer coating porous to migration of the first solvent through the overcoat layer coating until the charge transport layer is substantially dry, increasing the heat applied to the overcoat layer coating to form a substantially dry overcoat layer.

BRIEF SUMMARY OF THE INVENTION

It is, therefore, an object of the present invention to provide an improved electrophotographic imaging member which overcomes the above-noted deficiencies.

It is another object of the present invention to provide an improved electrophotographic imaging member which exhibits longer wear life.

It is still another object of the present invention to provide thicker overcoats without the Photo-Induced Discharge Characteristics (PIDC) being adversely affected by mobility limitations in the overcoat layer.

It is still another object of the present invention to provide thicker overcoats without significant light attenuation in the overcoat.

It is still another object of the present invention to provide thicker overcoats where the charge carriers causing conductivity emanate from two different sources.

The foregoing objects and others are accomplished in accordance with this invention by providing an electrophotographic imaging member comprising at least one photographic imaging layer and a partially electrically conductive overcoat layer comprising finely divided charge injection enabling particles dispersed in a charge transporting continuous matrix comprising a cross linked polyamide, charge transport molecules and oxidized charge transport molecules, the continuous matrix being formed from a solution selected from the group comprising a first solution comprising crosslinkable alcohol soluble polyamide containing methoxy methyl groups attached to amide nitrogen atoms, an acid having a $pK_a$ less than about 3, a cross linking agent selected from the group comprising a formaldehyde generating cross linking agent, an alkoxylated cross linking agent, a methylolamine cross linking agent and mixtures thereof, a dihydroxy arylamine, and a liquid selected from the group comprising alcohol solvents, diluent and mixtures thereof, a second solution comprising crosslinkable alcohol soluble polyamide free of methoxy methyl groups attached to amide nitrogen atoms, an acid having a $pK_a$ less than about 3, a cross linking agent selected from the group comprising a an alkoxylated cross linking agent, a methylolamine cross linking agent and mixtures thereof, a dihydroxy arylamine, and a liquid selected from the group comprising alcohol solvents, diluent and mixtures thereof.

The electrophotographic imaging member may be imaged by providing an electrophotographic imaging member having a charge generator layer, a charge transport layer and an overcoat layer, the overcoat layer comprising charge injecting particles dispersed in an electrically conductive charge transporting matrix, the matrix comprising charge transport molecules and oxidized charge transport molecules molecularly dispersed or dissolved in a cross linked polyamide, the overcoat layer having a surface which forms an interface with the transport layer and also having an exposed imaging surface, applying a uniform negative charge to the exposed imaging surface to stimulate injection of free charges from the electrically conductive charge transporting matrix and free charges from the charge injecting particles into the electrically conductive charge transporting matrix to transport the negative charge from the imaging surface of the overcoat layer to the interface between the overcoat layer and the transport layer. This imaging member may be further processed by exposing the imaging member to activating radiation in image configuration to form an electrostatic latent image, developing the latent image with toner particles to form a toner image, and transferring the toner image to a receiving member.

DESCRIPTION OF THE DRAWINGS

A more complete understanding of the present invention can be obtained by reference to the accompanying drawings wherein.

Figure 1:
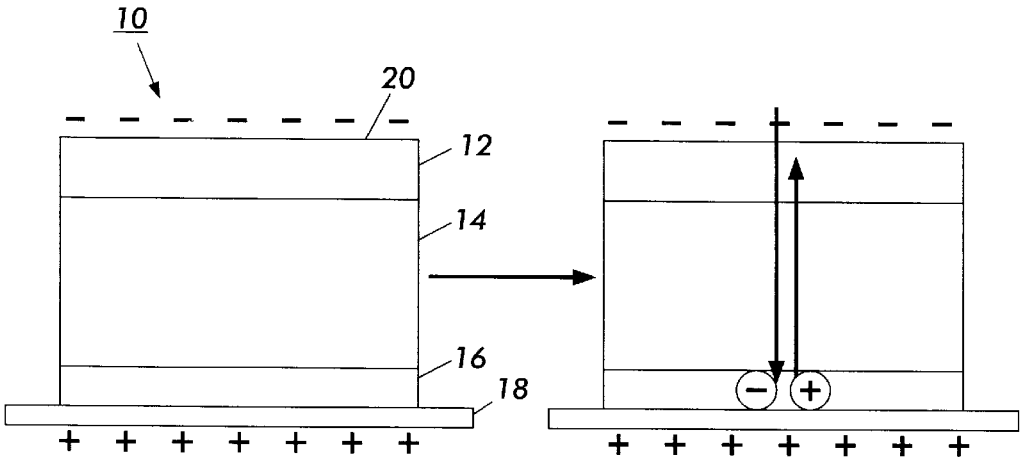
FIG. 1 PRIOR ART
FIG. 1 schematically illustrates the location of charges during imaging with a prior art photoreceptor is overcoated with an insulating charge transporting layer.

These figures merely schematically illustrate the invention and are not intended to indicate relative size and dimensions of the device or components thereof.

DETAILED DESCRIPTION OF THE DRAWING

Photoreceptor overcoating concepts may be divided in to basic two classifications based on the way the overcoatings function, i.e., (1) insulating charge transporting and (2) partially conducting.

In FIG. 1, a photoreceptor 10 is illustrated with an insulating charge transporting overcoat layer 12 overlying a charge transport layer 14. A charge generator layer 16 is sandwiched between the charge transport layer 14 and a conductive layer 18. The charge generator layer 16 comprises photoconductive pigment material. The overcoat layer 12 is an extension of the transport layer 14 and is essentially electrically insulating. When the photoreceptor 10 with the overcoat layer 12 is negatively corona charged in the dark during an imaging cycle, the negative ions from the corotron are placed on the exposed outer imaging surface 20 of the overcoat layer 12. The deposited uniform negative charge stays on top of the exposed outer imaging surface 20 of the overcoating layer 12. During the image exposure step, photons from imagewise exposure are absorbed in the photoconductive pigment material within the generator layer 16. The photogenerated holes are injected into the transport layer and transit the transport layer; these holes are then injected into the overcoat layer and transit through the overcoat layer. Charge transporting must occur through the overcoating layer during image exposure. The thickness of overcoat layer 12 is limited by the charge carrier mobility in the overcoat layer. Low mobility in the overcoat layer 12 results in charge carriers transiting part of the way through the overcoat layer thereby decreasing the amount of discharge for a given exposure. The thickness of the overcoat layer 12 is limited to about 3 micrometers maximum for quality images if the charge carrier mobility is ~10–7 $cm^2$/Vsec. An example of an insulative charge transporting type is cross linked polyamide such as Luckamide containing dihydroxyarylamine. Luckamide is available from Dai Nippon Ink and the charge carrier mobility in this overcoat is ~10–7 $cm^2$/Vsec.

When an overcoat is partially electrically conducting, results occur that are different from that illustrated above for electrically insulating charge transporting overcoat layers. When a photoreceptor overcoated with a partially electrically conducting overcoat is negatively charged in the dark, the negative charges placed on the overcoat surface, make their way (due to the conductivity of the overcoat layer) to the interface between the overcoat layer and the transport layer prior to imagewise exposure. During the imagewise exposure step, the photons are absorbed in the photoconductive pigment material within the generator layer. The resulting photogenerated holes are injected into the transport layer and transit the charge transport layer and complete discharge of the photoreceptor.

Partially electrical conductivity of an overcoat layer can be achieved in different ways. For example, in one embodiment, an overcoat layer of a photoreceptor can contain electrically conductive particles (such as $SnO_2$) in an electrically insulating polymer matrix, the concentration of the particles being high enough to assure particle contact between the electrically conductive particles. In this embodiment, the contacting electrically conductive particles form chains and electrical conductivity arises from free carriers within the electrically conductive particles being transported through the chains.

Figure 2:
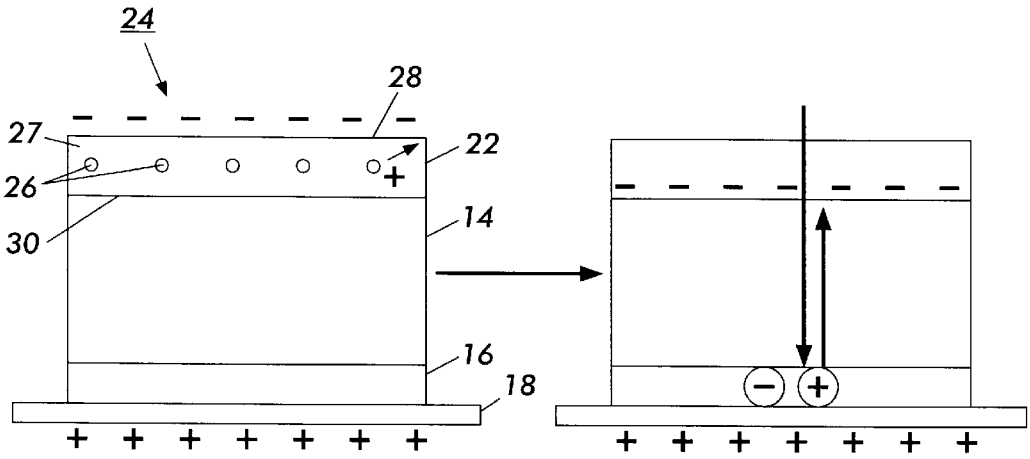
FIG. 2 PRIOR ART
FIG. 2 schematically illustrates the location of charges during imaging with a prior art photoreceptor overcoated with a partially electrically conductive layer containing particles in a binder.

In another embodiment, illustrated in FIG. 2, an overcoat layer 22 of photoreceptor 24 contains a small concentration of charge injecting particles 26 dispersed in a charge transporting matrix 27 containing charge transport molecules dispersed in a polymeric binder. In this embodiment; free charges are injected from the charge injecting particles 26 into the charge transporting matrix and thereby transport corona deposited negative charges from the exposed outer imaging surface 28 of the overcoat layer 22 to the interface 30 between the overcoat layer 22 and the transport layer 14. This embodiment is described, for example, in U.S. Pat. No. 4,515,882, the entire disclosure thereof being incorporated herein by reference.

Figure 3:
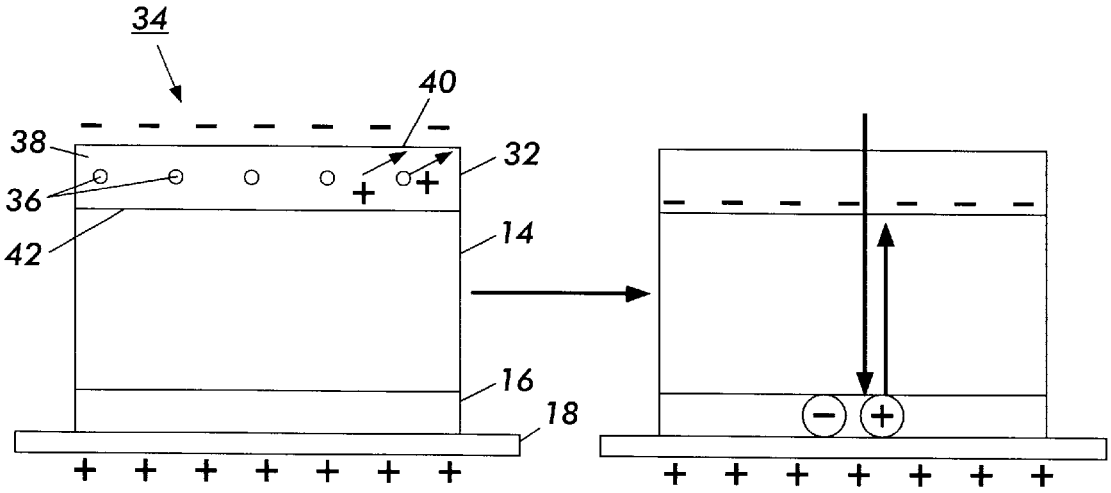
FIG. 3 schematically illustrates the location of charges during imaging with a photoreceptor overcoated with a partially electrically conductive overcoating embodiment of this invention.

In the embodiment constituting this invention, illustrated in FIG. 3, an overcoat layer 32 of photoreceptor 34 contains a small concentration of charge injecting particles 36 dispersed in an electrically conductive charge transporting matrix 38 comprising charge transport molecules and oxidized charge transport molecules dispersed in a polymeric binder. After formation of a uniform negative charge, free charges from the electrically conductive charge transporting matrix 38 as well as from the charge injecting particles 36 are injected into the electrically conductive charge transporting matrix 38 and thereby transport the corona deposited negative charges from the exposed outer imaging surface 40 of the overcoat layer 32 to the interface 42 between the overcoat layer 32 and the transport layer 14.

In the partially electrically conducting overcoat layer embodiments, the corona deposited negative charges effectively end up at the interface between the overcoat layer the transport layer so the photo induced discharge curve (PIDC) is not affected by the presence of the overcoat layer. PIDC considerations do not set any limit to the overcoat thickness. The overcoat layer thickness limit is set by Modulation Transfer Function (MTF) considerations. The charge pattern on the transport layer surface causes a field pattern above the exposed outer imaging surface. This field is both a function of the frequency of the charge pattern and a function of the perpendicular distance away from the interface between the overcoat layer and transport layer. During the development step, the charged toner particles are driven to the photoreceptor surface by the electric fields. By having an overcoat layer on the charge pattern, the field at the exposed outer imaging surface of the overcoat layer is reduced. This reduction is higher for high frequency image patterns. The electric field strength experienced by the toner particles as a function of image frequency is termed Modulation Transfer Function (MTF).

Electrophotographic imaging members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like. Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly (amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylaminostyryl)-S-(4"-diethylamino phenyl)pyrazoline, diamines such as N,N'diphenyl-N,N'-bis (3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. However, to avoid cycle-up, the charge transport layer should be substantially free of triphenyl methane. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine.

Any suitable electrically inert polymeric binder may be used to disperse the electrically active molecule in the charge transport layer is a poly(4,4'-isopropylidene-di phenylene)carbonate (also referred to as bisphenol-A-polycarbonate), poly(4,4'-isopropylidene-diphenylene) carbonate, poly(4,4'-diphenyl-1,1'-cyclohexane carbonate), and the like. Other typical inactive resin binders include polyester, polyarylate, polyacrylate, polyether, polysulfone, and the like. Weight average molecular weights can vary, for example, from about 20,000 to about 150,000.

Instead of a small molecule charge transporting compound dissolved or molecularly dispersed in an electrically inert polymeric binder, the charge transport layer may comprise any suitable charge transporting polymer. A typical charge transporting polymers is one obtained from the condensation of N,N'-diphenyl-N,N'-bis(3-hydroxyphenyl)-(1,1'-biphenyl)-4,4'-diamine and diethylene glycol bischloroformate such as disclosed in U.S. Pat. No. 4,806,443 and U.S. Pat. No. 5,028,687, the entire disclosures of these patent being incorporated herein by reference. Another typical charge transporting polymer is poly [(N,N'-bis-3-oxyphenyl)-N,N'-diphenyl-(1,1'-biphenyl)-(4,4'-diamine)-co-sebacoyl polyester obtained from the condensation of N,N'-diphenyl-N,N'-bis(3-hydroxyphenyl)-1,1'-biphenyl-4,4'-diamine and sebacoyl chloride.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The electrophotographic imaging member of this invention comprises at least one photographic imaging layer and a partially electrically conductive overcoat layer comprising finely divided charge injection enabling particles dispersed in

- a charge transporting continuous matrix comprising a cross linked polyamide, charge transport molecules and oxidized charge transport molecules, the continuous matrix being formed from a solution selected from the group comprising
  - a first solution comprising
    - crosslinkable alcohol soluble polyamide containing methoxy methyl groups attached to amide nitrogen atoms,
    - an acid having a $pK_a$ of less than about 3,
    - a cross linking agent selected from the group comprising a formaldehyde generating cross linking agent, an alkoxylated cross linking agent, a methylolamine cross linking agent and mixtures thereof,
    - a dihydroxy arylamine, and
    - a liquid selected from the group comprising alcohol solvents, diluent and mixtures thereof,
  - a second solution comprising
    - crosslinkable alcohol soluble polyamide free of methoxy methyl groups attached to amide nitrogen atoms,
    - an acid having a $pK_a$ value of less than about 3,
    - an alkoxylated cross linking agent, a methylolamine cross linking agent and mixtures thereof,
    - a dihydroxy arylamine, and
    - a liquid selected from the group comprising alcohol solvents, diluent and mixtures thereof.

Any suitable cross linkable hole insulating film forming alcohol soluble polyamide polymer may be employed in the overcoating of this invention. Amongst all polyamides there are two classes: a first class of alcohol polyamides containing methoxymethyl groups and a second class of polyamides other alcohol soluble polyamides free of methoxymethyl groups. Any suitable formaldehyde generating cross linking agent, alkoxylated cross linking agent, methylolamine cross linking agent or mixtures thereof may be utilized for enhancing cross linking of the first class of alcohol soluble polyamides containing methoxymethyl groups. Typical formaldehyde generating materials include, for example, trioxane, 1,3-dioxolane, dimethoxymethane, hydroxymethyl substituted melamines, formalin, and the like. The expression "formaldehyde generating material" as employed herein is defined as a source of latent formaldehyde or methylene dioxy or hydroxy methyl ether groups.

Typical alkoxylated cross linking agents are alkoxylated include, for example, hexamethoxymethyl melamine (e.g. Cymel 303), dimethoxymethane (methylal), methoxymethyl melamine, butyl etherified melamine resins, methyl etherified melamine resins, methyl-butyl etherified melamine resins and methyl-isobutyl etherified melamine resins and the like. The expression "alkoxylated cross linking agents" as employed herein is defined as cross linking agents with alkoxyalkyl functional groups. An alkoxyalkyl groups may be represented by ROR'- wherein R is an alkyl group containing from 1 to 4 carbon atoms and R' is an alkylene or isoalkylene group containing from 1 to 4 carbon atoms. A preferred alkoxylated cross linking agent is hexamethoxymethyl melamine represented by the formula:

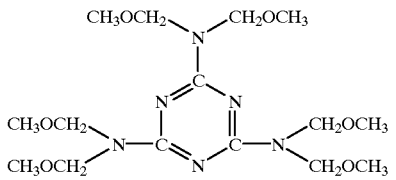

The expression "methylolamine cross linking agents" as employed herein is defined as cross linking agents with >N—$CH_2OH$ functional groups. Typical methylolamine cross linking agents include, for example, trimethylolmelamine, hexamethylolmelamine, and the like. Methylolamine cross linking agents may be prepared, for example, by mixing melamine and formaldehyde in a reaction vessel in the proper ratios under the correct conditions to form a methylol melamine which contains —N—$CH_2OH$ groups. A typical methylolamine is hexamethylolmelamine represented by the following structure:

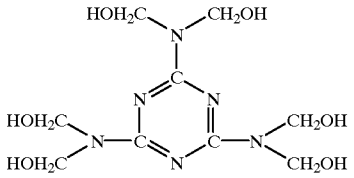

These methylol products can be alkoxylated to form alkoxylated melamines [e.g., methoxylmethylmelamine]. Thus, condensation products of melamine and formaldehyde are precursors for methoxymethylated materials. Hexamethylolmelamine will function in a similar cross-linking manner as hexamethoxymethylmelamine.

Alkoxylated cross linking agents and methylolamine cross linking agents are commercially available. Typical commercially available cross linking agents include, for example, amine derivatives such as hexamethoxymethyl melamine, and/or condensation products of an amine, e.g. melamine, diazine, urea, cyclic ethylene urea, cyclic propylene urea, thiourea, cyclic ethylene thiourea, aziridines, alkyl melamines, aryl melamines, benzo guanamines, guanamines, alkyl guanamines and aryl guanamines, with an aldehyde, e.g. formaldehyde. A preferred cross-linking agent is the condensation product of melamine with formaldehyde. The condensation product may optionally be alkoxylated. The weight average molecular weight of the cross-linking agent is preferably less than 2000, more preferably less than 1500, and particularly in the range from 250 to 500. Commercially available cross linking agents include, for example, CYMEL 1168, CYMEL 1161, and CYMEL 1158 (available from CYTEC Industries, Inc., Five Garret Mountain Plaza, West Paterson, N.J. 07424); RESIMENE 755 and RESIMENE 4514 (available from Monsanto Chemical Co.); butyl etherified melamine resins (butoxymethylmelamine resins) such as U-VAN 20SE-60 and U-VAN 225 (available from Mitsui Toatsu Chemicals Inc.) and SUPERBECKAMINE G840 and SUPERBECKAMINE G821 (available from Dainippon Ink & Chemicals, Inc.); methyl etherified melamine resins (methoxymethyl melamine resins) such as CYMEL 303, CYMEL 325, CYMEL 327, CYMEL 350 and CYMEL 370 (available form Mitsui Cyanamide Co., Ltd.), NIKARAK MS17 and NIKARAK MS15 (available from Sanwa Chemicals Co., Ltd.), Resimene 741 (available from Monsanto Chemical Co., Ltd.) and SUMIMAL M-100, SUMIMAL M-40S and SUMIMAL M55 (available from Sumitomo Chemical Co., Ltd.); methyl-butyl etherified melamine resins (methoxy/butoxy methylmelamines) such as CYMEL 235, CYMEL 202, CYMEL 238, CYMEL 254, CYMEL 272 and CYMEL 1130 (available from Mitsui Cyanamide Co., Ltd.) and SUMIMAL M66B (available from Sumitomo Chemical Co., Ltd.); and methyl-isobutyl etherified melamine resins (methoxy/isobutoxy melamine resins). such as CYMEL XV 805 (available from Mitsui Cyanamide Co., Ltd.) and NIKARAK MS 95 (available from Sanwa Chemical Co., Ltd.). Still other alkoxylated melamine resins such as methylated melamine resins include CYMEL 300, CYMEL 301 and CYMEL 350 (available from American Cyanamid Company).

The formaldehyde generating material such as trioxane in the coating composition serves to cross link the crosslinkable alcohol soluble polyamide containing methoxy methyl groups attached to amide nitrogen atoms. Preferably the coating composition comprises between about 5 percent by weight and about 10 percent by weight trioxane based on the total weight of the crosslinkable alcohol soluble polyamide containing methoxy methyl groups attached to amide nitrogen atoms. The combination of oxalic acid and trioxane facilitates cross linking of the polyamide at lower temperatures. Although all polyamides are alcohol soluble, all polyamides are normally not cross linkable. However, with special materials such as alkoxylated cross linking agents (e.g., Cymel 303) or methylolamine cross linking agents, all polyamides can be cross linkable.

A preferred methoxymethyl generating material is hexamethoxymethylmelamine which serves as a cross linking agent for the polyamide. Hexamethoxymethylmelamine may be represented by the following structure:

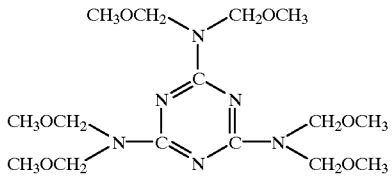

Hexamethoxymethylmelamine is available commercially, for example, Cymel 303, from CYTEC Industries Inc., W. Patterson, New Jersey. Preferably the coating composition comprises between about 1 percent by weight and about 50 percent by weight hexamethoxymethylmelamine based on the total weight of polyamide. When less than about 1 percent by weight hexamethoxymethylmelamine is used, the cross-linking efficiency is too low. When greater than about 50 percent by weight hexamethoxymethylmelamine is used, the resulting films highly plasticized.

For the second class of alcohol soluble polyamides free of methoxymethyl groups, a methoxymethyl generating material can be used to enhance the cross-linking. Any suitable methoxymethyl generating material may be utilized for enhancing cross linking of the second class of alcohol soluble polyamides free methoxymethyl groups. Typical methoxymethyl generating material include the same methoxymethyl generating materials described above with reference to enhance cross-linking of first class of alcohol soluble polyamides containing methoxymethyl groups.

A preferred polyamide for the first solution comprises a cross linkable alcohol soluble polyamide polymers having methoxy methyl groups attached to the nitrogen atoms of amide groups in the polymer backbone prior to cross linking is selected from the group consisting of materials represented by the following formulae I and II:

I

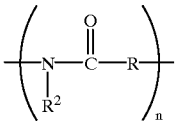

wherein:

n is a positive integer,

R is independently selected from the group consisting of alkylene, arylene or alkarylene units, between 1 and 100 percent of the $R^2$ sites are —H, and the remainder of the $R^2$ sites are —$CH_2$—O—$CH_3$ and

II

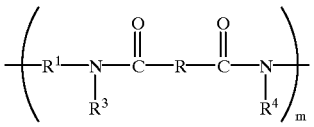

wherein:

m is a positive integer,

R' and R are independently selected from the group consisting of alkylene, arylene or alkarylene units, between 1 and 100 percent of the $R^3$ and $R^4$ sites are —H, and the remainder of the $R^3$ and $R^4$ sites are —$CH_2$—O—$CH_3$.

In the above formula, the methoxy groups participate in cross linking while the added sources of formaldehyde accelerate the cross-linking rate and the sources of methoxymethyl groups (e.g., Cymels) cross-link the polyamide chains further by reacting with the unsubstituted —N—H groups. In the presence of acids and elevated temperatures, these methoxy methyl groups in the first class of polyamides containing methoxy methyl groups attached to amide nitrogen atoms are hydrolyzed to (methylol groups) which decompose to form cross linked polymer chains and methanol byproduct. The addition of a cross linking agent selected from the group comprising a formaldehyde generating cross linking agent, an alkoxylated cross linking agent, a methylolamine cross linking agent and mixtures thereof accelerate the cross-linking rates. These polyamides should form solid films if dried prior to crosslinking. The polyamide should also be soluble, prior to cross-linking, in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to cross linking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone.

A preferred polyamide for the second solution comprises a crosslinkable alcohol soluble polyamide free of methoxy methyl groups attached to amide nitrogen atoms prior to cross linking is represented by the following formulae I and II:

I

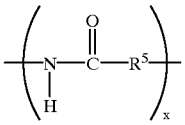

wherein:

x is a positive integer, $R^5$ is independently selected from the group consisting of alkylene, arylene or alkarylene units, and

II

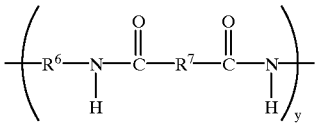

wherein:

y is a positive integer, and $R^6$ and $R^7$ are independently selected from the group consisting of alkylene, arylene or alkarylene units.

Typical alcohol soluble polyamide polymers free of methoxy methyl groups attached to the nitrogen atoms of amide groups in the polymer backbone prior to cross linking include, for example, Elvamides from DuPont de Nemours & Co., and the like. These polyamides should form solid films if dried prior to crosslinking. These polyamides can be alcohol soluble, for example, with polar functional groups, such as methoxy, ethoxy and hydroxy groups, pendant from the polymer backbone. By the addition of an alkoxylated cross linking agent, a methylolamine cross linking agent and mixtures thereof (e.g., Cymels) cross-linked polyamides can be obtained under suitable acidic conditions and thermal cures. Generally, the dried and cured overcoat comprises between about 30 percent by weight and about 70 percent by weight polyamide, based on the total weight of overcoat layer after drying and curing.

Since the film forming polyamides are also soluble in a solvent, they can be readily coated by conventional coating techniques. Typical solvents include, for example, butanol, methanol, butyl acetate, ethanol, cyclohexanone, tetrahydrofuran, methyl ethyl ketone, and the like and mixtures thereof. Typical diluents include, for example, 1,3 dioxolane, tetrahydrofuran, chlorobenzene, fluorobenzene, methylene chloride, and the like and mixtures thereof.

Generally, sufficient cross linking agent should be added to the coating composition to achieve cross linking at least by the time drying of the coating is completed. Typical amounts of cross linking agent range from about 1 percent by weight and 30 percent by weight based on the weight of the polyamide.

Crosslinking is accomplished by heating in the presence of a catalyst. Any suitable catalyst may be employed. Typical catalysts include, for example, oxalic acid, p-toluenesulfonic acid, methanesulfonic acid, maleic acid, phosphoric acid, hexamic acid and the like and mixtures thereof. These acids have a $pK_a$ of less than about 3, and more preferably, between about 0 and about 3. Catalysts that transform into a gaseous product during the cross linking reaction are preferred because they escape the coating mixture and leave no residue that might adversely affect the electrical properties of the final overcoating. A typical gas forming catalyst is, for example, oxalic acid. The temperature used for cross linking varies with the specific catalyst and heating time utilized and the degree of cross linking desired. Generally, the degree of cross linking selected depends upon the desired flexibility of the final photoreceptor. For example, complete cross linking may be used for rigid drum or plate photoreceptors. However, partial cross linking is preferred for flexible photoreceptors and the desired degree of cross linking will vary depending example, web or belt configurations. The degree of cross linking can be controlled by the relative amount of catalyst employed and the amount of specific polyamide, cross linking agent, catalyst, temperature and time used for the reaction. A typical cross linking temperature used for Luckamide with oxalic acid as a catalyst is about 125° C. for 30 minutes. After cross linking, the overcoating should be substantially insoluble in the solvent in which it was soluble prior to cross linking. Thus, no overcoating material will be removed when rubbed with a cloth soaked in the solvent. Cross linking results in the development of a three dimensional network which restrains the dihydroxy arylamine molecule as a fish is caught in a gill net. Prolonged attempts to extract the highly fluorescent dihydroxy arylamine hole transport molecule from the crosslinked overcoat, using long exposure to branched hydrocarbon solvents, revealed that the transport molecule is completely immobilized. Thus when UV light is used to examine the extractant or the applicator pad no fluorescence is observed. The molecule is also locked into the overcoat by hydrogen bonding to amide sites on the polyamide.

The overcoating of this invention also includes dihydroxy arylamine charge transport molecules. Preferably, the dihydroxy arylamine is represented by the following formula:

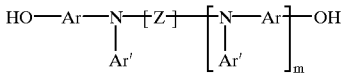

wherein m is 0 or 1,

Z is selected from the group consisting of:

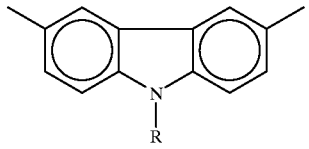

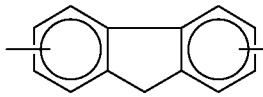

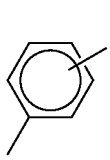

and

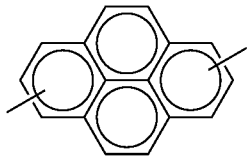

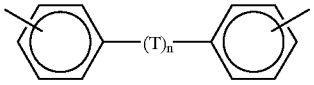

Ar is selected from the group consisting of:

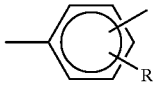

and

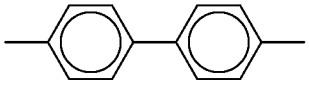

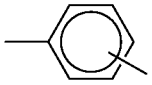

R is selected from the group consisting of —$CH_3$, —$C_2H_5$, —$C_3H_7$, and —$C_4H_9$, Ar' is selected from the group consisting of:

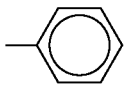

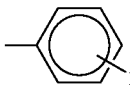

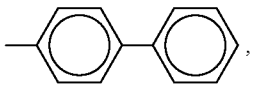

and

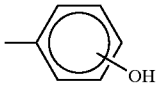

T is selected from the group consisting of:

—$CH_2$—, —$C(CH_3)$—, —O—, —S—,

-continued

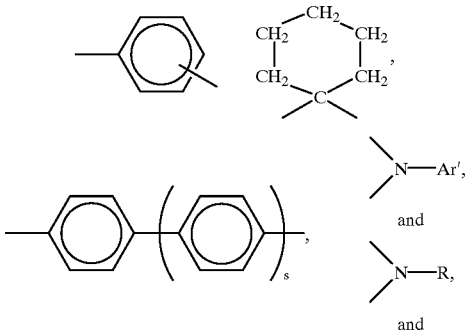

s is 0, 1 or 2.

This hydroxyarylamine compound is described in detail in U.S. Pat. No. 4,871,634, the entire disclosure thereof being incorporated herein by reference. Although, many conventional charge transporting materials will not dissolve in all polyamides, the cross linkable polyamides employed in the overcoat compositions of this invention contain hydroxy groups and are alcohol soluble along with the dihydroxy arylamine charge transporting material.

Generally, the hydroxy arylamine compounds are prepared, for example, by hydrolyzing an dialkoxy arylamine. A typical process for preparing alkoxy arylamines is disclosed in Example I of U.S. Pat. No. 4,588,666 to Stolka et al, the entire disclosure of this patent being incorporated herein by reference.

Typical hydroxy arylamine compounds useful for the overcoating composition of this invention include, for example:

N,N'-diphenyl-N,N'-bis(3-hydroxyphenyl)-[1,1'-biphenyl]-4,4'-diamine;

N,N,N',N',-tetra(3-hydroxyphenyl)-[1,1'-biphenyl]-4,4'-diamine;

N,N-di(3-hydroxyphenyl)-m-toluidine;

1,1-bis-[4-(di-N,N-m-hydroxpyphenyl)-aminophenyl]-cyclohexane;

1,1-bis[4-(N-m-hydroxyphenyl)-4-(N-phenyl)-aminophenyl]-cyclohexane;

bis-(N-(3-hydroxyphenyl)-N-phenyl-4-aminophenyl)-methane;

bis[(N-(3-hydroxyphenyl)-N-phenyl)-4-aminophenyl]-isopropylidene;

N,N'-diphenyl-N,N'-bis(3-hydroxyphenyl)-[1,1':4',1"-terphenyl]-4,4"-diamine;

9-ethyl-3,6-bis[N-phenyl-N-3(3-hydroxyphenyl)-amino]-carbazole;

2,7-bis[N,N-di(3-hydroxyphenyl)-amino]-fluorene;

1,6-bis[N,N-di(3-hydroxyphenyl)-amino]-pyrene;

1,4-bis[N-phenyl-N-(3-hydroxyphenyl)]-phenylenediamine.

The concentration of the hydroxy arylamine in the overcoat can be between about 2 percent and about 50 percent by weight based on the total weight of the dried and cured overcoat. Preferably, the concentration of the hydroxy arylamine in the overcoat layer is between about 10 percent by weight and about 50 percent by weight based on the total weight of the dried and cured overcoat layer. These concentrations are for the combination of both the charge transport molecules and the oxidized charge transport molecules in the dried and cured overcoat layer. When less than about 10 percent by weight of hydroxy arylamine is present in the overcoat, a residual voltage may develop with cycling resulting in background problems. Also a humidity dependence of conductivity might arise. If the amount of hydroxy arylamine in the overcoat exceeds about 50 percent by weight based on the total weight of the overcoating layer, crystallization may occur resulting in residual cycle-up. In addition, mechanical properties, abrasive wear properties are negatively impacted.

The oxalic acid in the coating composition serves to cross link the polyamide and oxidize the dihydroxy amine. The oxidation of the molecules makes the overcoat partially conducting even in the absence of charge injection particles. The concentration requirement of injection particles needed to transfer the corona deposited negative charges from the free surface (exposed outer surface) of the overcoat to the interface between the overcoat and transport layer is less in the presence of the oxidized species of the charge transport molecules. This helps to make the overcoat transparent to exposure light (imagewise activating radiation) in the presence of charge injection particles such as carbon.

Preferably the coating composition comprises between about 6 percent by weight and about 15 percent by weight acid based on the total weight of polyamide, the acid having a $pK_a$ of less than about 3 and, more preferably, between about 0 and about 3. When less than about 6 percent by weight acid is used, the polyamide is not completely cross linked. When greater than about 15 percent by weight acid is used, the overcoat starts absorbing an undesirable amount of light from the exposure/erase (activating radiation) sources.

Generally, the soluble components of the overcoat coating mixture are mixed in a suitable solvent or mixture of solvents prior to the addition of the charge injecting particles. Any suitable solvent may be utilized. Preferably the solvent is methanol, ethanol, propanol, and the like and mixtures thereof. The solvent selected should not adversely affect the underlying photoreceptor. For example, the solvent selected should not dissolve or crystallize the underlying photoreceptor. The relative amount of solvent employed depends upon the specific materials and coating technique employed to fabricate the overcoat. Typical ranges of solids include, for example, between about 5 percent by weight to about 40 percent by weight soluble solids. Preferably, the charge injecting particles are dispersed in a solution of the cross linkable polyamide and charging transporting material. It is believed that hydrogen bonding takes place in the dried films.

Any suitable charge injecting particles may be utilized. These particles are of the injecting type and are a source of holes (carriers). Typical charge injecting particles include, for example, carbon, tin oxide, iron, and the like.

The charge injection enabling particles may be hole injection enabling particles for material compositions that employ hole transporting materials or electron injection enabling particles for material compositions that employ electron transporting materials in the overcoat. Any particle can function as a charge injection enabling particle as long as the concentration of the particles and the entire electric field are sufficient to cause the charge injection enabling particles to rapidly polarize and inject charge carriers into the continuous phase of the overcoating layer. Typical inorganic charge injection enabling particles include carbon (e.g., carbon black), fluorinated carbon black activated charcoal, tin oxide, iron oxide, molybdenum disulfide, silicon, antimony oxide, chromium dioxide, zinc oxide, titanium oxide, magnesium oxide, manganese dioxide, aluminum oxides, other metal oxides, colloidal silica, colloidal silica treated with silanes, graphite, fluorinated graphite tin, aluminum, nickel, steel, silver, gold, other metals, their oxides, sulfides, halides and other salt forms, fullerenes and the like. Preferably, the finely divided charge injection enabling particles are finely divided carbon particles or tin oxide particles because both of them inject very efficiently through dihydroxyarylamine employed in the overcoat.

The particle size of the charge injection enabling particles should be less than about 45 micrometers but preferably should be less than about 10 micrometers and less than the wavelength of light utilized to rapidly expose the underlying photoconductive layers. In other words the particle size should be sufficient to maintain the overcoating layer substantially transparent to the wavelength of light to which the underlying photoconductive layer or layers are sensitive. A particle size between about 100 Angstroms and about 500 Angstroms has been found suitable for light sources having a wavelength greater than about 4,000 Angstroms. Thus, the transparent overcoating layer should be substantially transparent to activating radiation to which the underlying photoconductive layer is sensitive. More specifically, the transmitted activating radiation should be capable of generating charge carriers, i.e. electron-hole pairs in the underlying photoconductive layer or layers. A transparency range of between about 10 percent and about 100 percent can provide satisfactory results depending upon the specific photoreceptors utilized. A transparency of at least about 50 percent is preferred for greater speed with optimum speeds being achieved at a transparency of at least 80 percent.

Generally, the overcoating layer should contain at least about 0.025 percent by weight of the charge injection enabling particles based on the total weight of the overcoating layer after drying and curing. At lower concentrations, a noticeable residual charge tends to form, which at lower levels, can be compensated during development by applying an electric bias as is well known in the art. The upper limit for the amount of the charge injection enabling particles to be used depends upon the relative quantity of charge flow desired through the overcoating layer, but should be less than that which would reduce the transparency of the overcoating to a value less than about 10 percent and which would render the overcoating too conductive. Thus, for example, when carbon black particles are utilized, a transparent overcoating layer should contain less than about 1 percent by weight of carbon black based on the total weight of the overcoating layer after drying and curing. Preferably, a weight basis for transparent overcoating layers, where carbon black particles are utilized, the carbon black is present in an amount between about 0.03 and about 0.15 weight percent, based on the weight of the polyamide after drying and curing. For tin oxide charge injecting particles, the weight percent for transparent overcoating is between about 8 percent and about 10 percent by weight, based on the weight of the polyamide.

The components of the overcoating layer may be mixed together by any suitable conventional means. Typical mixing means include stirring rods, ultrasonic vibrators, magnetic stirrers, paint shakers, sand mills, roll pebble mills, sonic mixers, melt mixing devices and the like. After mixing the charge injection particles in the solution of solvent soluble components such as the cross linkable polyamide and dihydroxy arylamine to form coating mixture containing a dispersion of the particles, the coating mixture is applied to the photoreceptor by any suitable coating process. As indicated above, all the components of the overcoating layer of this invention except the charge injecting particles are solvent soluble. Typical coating techniques include spraying, draw bar coating, dip coating, gravure coating, silk screening, air knife coating, reverse roll coating, extrusion techniques, wire wound rod coating, and the like.

Drying and curing of the deposited overcoat layer may be accomplished by any suitable technique. Typical drying techniques include, for example, oven drying, infrared radiation drying, air drying and the like. Upon completion of drying and curing, the polyamide in the overcoat layer is cross linked and insoluble in alcohol. The dried overcoating of this invention should transport holes during imaging and should not have too high a free carrier concentration. Free carrier concentration beyond the number required to transfer the corona deposited charge on the free surface of the overcoat layer to the interface between the overcoat and transport layers could blur the image charge pattern.

Upon completion of drying and curing, the cross linked polyamide holds the transport molecules and the oxidized transport molecules in solid solution or as a molecular dispersion. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale.

After the imagewise exposure step, the photogenerated holes must transit the charge transport layer only. Therefore, the overcoat layer thickness is not a factor in PIDC calculations. The acronym PIDC, as employed herein, is defined as Photo Induced Discharge Characteristics and is a curve of photoreceptor discharge potential as a function of light exposure. The limit to the overcoat thickness is not set by PIDC (theoretically from PIDC perspective, the overcoat layer can be tens of micrometers thick). The limit to the overcoat thickness is set by Modulation Transfer Function (MTF). The MTF is the electric field [as a function of frequency (dpi)] experienced by the toner during the development step just beyond the top surface of the photoconductor. This limiting thickness depends on the resolution requirements of the device and may be between about 1 micrometer and about 15 micrometers. Generally, overcoating thicknesses less than about 1 micrometer fail to provide sufficient protection for the underlying photoreceptor. Greater protection is provided by an overcoating thickness of at least about 3 micrometers. Resolution of the final toner image begins to degrade when the overcoating thickness exceeds about 15 micrometers. Clearer image resolution is obtained with an overcoating thickness less than about 8 micrometers. Thus, an overcoating thickness of between 3 micrometers and about 8 micrometers is preferred for optimum protection and image resolution. The thickness of the overcoating is preferably between about 5 and about 6 micrometers for most applications. This preferred thickness is about twice that for the ordinary insulating overcoatings. Twice the overcoat thickness doubles the wear life of the overcoat. The thicker overcoat of this invention exhibits an excellent wear rate resistance and substantially no increase in PIDC tails.

Generally, a sufficient concentration of charge injection enabling particles is present when the charge injection enabling particles instantly polarize in the dark in less than about $10^{-12}$ second and inject charge carriers into the continuous phase in less than about 10 microseconds in an electric field greater than about 5 volts per micrometer applied across the overcoating layer and the photoconductive layer or when the charge injection enabling particles polarize in the dark in more than about $10^{-2}$ second and inject charge carriers into the continuous phase in more than about 10 microseconds in an electric field less than about 5 volts per micrometer applied across the overcoating layer and the photoconductive layer. Thus charge injection enabling particles polarize in less than about $10^{-12}$ second and inject charge carriers into the continuous charge transporting phase in less than about 10 microseconds when an applied electric field of between about 5 volts per micrometer and about 80 volts per micrometer is applied in the dark across the imaging member from the conductive substrate to the outer surface of the overcoating and forms a residual voltage on the protective overcoating of less than about 10 to about 250 volts per micrometer. The electric field may be applied by any suitable charging technique. Typical charging techniques include corona charging, brush charging, stylus charging, contact charging and the like.

When conventional overcoating layers are prepared with only insulating film forming binder and charge transport molecules in solid solution or molecular dispersion in the film forming binder, the overcoating layer remains insulating after charging until at least the image exposure step. However, unlike conventional electrically insulating overcoatings, the overcoat of this invention is partially electrically conductive. Thus, as illustrated in FIG. 3, due to the partial conductivity of the overcoat layer 32, corona deposited negative charges move to the interface between the overcoat layer 32 and the charge transport layer 14 during and soon after the charging step. The expression "partially electrically conductive", as employed herein, is defined as one having just enough charge carriers for transfer of corona deposited charges from the free surface of the overcoat layer to the interface between the transport and overcoat layers. Preferably, the free carriers should be created by the applied field (field dependent conductivity); in this way, the free carriers are available to effectively transfer the corona deposited charge from the free surface of the photoconductor to the interface region between the overcoat layer and the transport layer. The density of the free carriers is considerably less in the low image field penetrating the overcoat layer. This low concentration of carriers after the charge/exposure step ensures that the image pattern is not spread (loss of resolution) by the free carriers. When the overcoating layer is partially electrically conductive and has between about 2 CV and about 10 CV of carriers per square cm, the carriers are used up in the process of transferring of corona deposited charges from the free surface of the overcoat layer to the interface between the transport and overcoat layers and the overcoating layer becomes temporarily insulating. Preferably, the overcoating has between about 3 CV about 5 CV of charge carriers per unit area of the device. CV represents the number of charges/unit area on the surface of the device where C is the capacitance of the device in Farads per unit area and V is the potential in volts to which the device is charged and can be determined by the charging characteristics which is the relationship between voltage across the device versus applied charge density. In the overcoat of U.S. Pat. No. 4,515,882, all the carriers in the overcoat required to transfer corona deposited charges from the free surface of the overcoat layer to the interface between the transport and overcoat layers originate in the injecting particles as opposed to the overcoating material composition of this invention where, the charge carriers required to transfer corona deposited charges from the free surface of the overcoat layer to the interface between the transport and overcoat layers originate in the overcoat material (oxidized transport molecules) and the injecting particles. This helps in reducing the required concentration of injecting particles and increases the transparency of the overcoat.

Thus, the overcoating layer of this invention acquires the capability of being an insulator until a sufficient electric field is applied. Application of the electric field (1) polarizes the charge injection enabling particles whereby the charge injection enabling particles inject charge carriers into the continuous phase of the overcoating layer, and, (2) coupled with the oxidized portion of the charge transport molecules acting as (a) free carriers as well as (b) field generated carriers in the continuous phase of the overcoat layer, allow (i) the charge carriers to be transported to and be trapped at the interface between the underlying photoconductive layer and the overcoating layer, and (ii) opposite space charge in the overcoating layer to relax by charge emission from the charge injection enabling particles to the outer imaging surface of the overcoating. Thus, the novel imaging structure of this invention provides excellent protection of photoconductive imaging members while markedly extending cycling wear life. Moreover, a relatively low concentration of charge injection enabling particles enhances overcoating layer integrity and allows a greater latitude in overcoating layer thickness with less impact on overcoating transparency. The overcoating layers of this invention also stick well to the transport layers.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

The "partially conductive" overcoats of this invention effectively transfer corona deposited charges from the free surface of the overcoat layer to the interface between the transport and overcoat layers, are insensitive to moisture, exhibit a wear rate of factor 10 to 20 lower than current commercial transport layers in machines employing corotrons/scrotrons for charging and a factor 3 to 5 lower than current commercial transport layers in machines employing Bias Charging Rolls/ Bias Transfer Rolls, can be formed as an overcoating layer coat without redissolving the transport layer, and can be coated to 4 to 6 microns in thickness without impacting Photo Induced Discharge Characteristics.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Several electrophotographic imaging members were prepared by applying by dip coating a charge blocking layer onto the rough surface of eight aluminum drums having a diameter of 4 cm and a length of 31 cm. The blocking layer coating mixture was a solution 12 of 8 weight percent polyamide (nylon 6) dissolved in 92 weight percent butanol, methanol and water solvent mixture. The butanol, methanol and water mixture percentages were 55, 36 and 9 percent by weight, respectively. The coating was applied at a coating bath withdrawal rate of 300 millimeters/minute. After drying in a forced air oven, the blocking layers had thicknesses of 1.5 micrometers. The dried blocking layers were coated with a charge generating layer containing 54 weight percent chloro gallium phthalocyanine pigment particles, 46 weight percent VMCH film forming polymer and employing xylene and n-butyl acetate solvents. 1.67 grams of VMCH was first dissolved in 8.8 grams of n-butyl acetate and 17.6 grams of xylene. After complete dissolution, 2 grams of chloro gallium phthalocyanine pigment particles were added and was ball milled. It was then diluted with 6 grams of 2:1 mixture of xylene/n-butyl acetate. The coatings were applied at a coating bath withdrawal rate of 300 millimeters/minute. After drying in a forced air oven, the charge generating layers had thicknesses of 0.2 micrometer. The drums were subsequently coated with charge transport layers containing N,N'-diphenyl-N,N'-bis(3-methylphenyl)-1,1;-biphenyl-4,4'-diamine dispersed in polycarbonate (PCZ200, available from the Mitsubishi Chemical Company). The coating mixture consisted of 8 weight percent N,N'-diphenyl-N,N'-bis(3-methylphenyl)-1,1'-biphenyl-4,4;-diamine, 12 weight percent binder and 80 weight percent monochlorobenzene solvent. The coatings were applied in a Tsukiage dip coating apparatus. After drying in a forced air oven for 45 minutes at 118° C., the transport layers had thicknesses of 20 micrometers.

EXAMPLE II

Polyamide containing methoxymethyl groups (Luckamide 5003 available from Dai Nippon Ink) [4 grams], methanol [20 grams] and 1-propanol [20 grams] were combined in an 8 ounce amber bottle and warmed with magnetic stirring in a water bath at about 60° C. A solution formed within 30 minutes which was then allowed to cool to 25° C. and N,N'-diphenyl-N,N'-bis(3-hydroxyphenyl)-1,1'-biphenyl-4,4'-diamine (DHTBD) [3.6 grams] was added and stirred until a complete solution was effected. Steel shot [500 grams] and Black Pearls carbon [0.25 gram] were added to the polymer solution and milled for 48 hours. The milled solution was passed through a Nitex filter [24 micrometers] to capture the steel shot and any large particulates. Oxalic acid [0.4 gram] was added and the mixture was warmed to 40° C.–50° C. until a solution formed. The solution was allowed to set overnight to insure mature viscosity properties. Overcoat layers [4 micrometers thick] were coated on three of the photoconductor drum photoreceptors of Example I using a Tsugiage ring coater and dried at 118° C. for 30 minutes.

EXAMPLE III

Luckamide [4 grams], methanol [20 grams] and 1-propanol [20 grams] were combined in an 8 ounce amber bottle and warmed with magnetic stirring in a water bath at about 60° C. A solution formed within 30 minutes which was then allowed to cool to 25° C. and N,N'-diphenyl-N,N'-bis(3-hydroxyphenyl)-1,1'-biphenyl-4,4'-diamine (DHTBD) [3.6 grams] was added and stirred until a complete solution was effected. Steel shot [500 grams] and Black Pearls carbon [0.25 gram] were added to the polymer solution and milled for 48 hours. The milled solution was passed through a Nitex filter [24 micrometers] to capture the steel shot and any large particulates. Oxalic acid [0.4 gram] and trioxane [0.3 gram] was added and the mixture was warmed to 40° C.–50° C. until a solution formed. The solution was allowed to set overnight to ensure mature viscosity properties. Overcoat layers [4 micrometers thick] were coated on three of the photoconductor drum photoreceptors of Example I using a Tsugiage ring coater and dried at 118° C. for 30 minutes.

EXAMPLE IV

Luckamide [4 grams], methanol [20 grams] and 1-propanol [20 grams] were combined in an 8 ounce amber bottle and warmed with magnetic stirring in a water bath at about 60° C. A solution formed within 30 minutes which was then allowed to cool to 25° C. and N,N'-diphenyl-N,N'-bis(3-hydroxyphenyl)-1,1'-biphenyl-4,4'-diamine (DHTBD) [3.6 grams] was added and stirred until a complete solution was achieved. Steel shot [500 grams] and Black Pearls carbon [0.25 gram] were added to the polymer solution and milled for 48 hours. The milled solution was passed through a Nitex filter [24 micrometers] to capture the steel shot and any large particulates. Oxalic acid [0.4 gram] and Cymel 303® [0.3 gram] was added and the mixture was warmed to 40° C.–50° C. until a solution formed. The solution was allowed to set overnight to ensure mature viscosity properties. Overcoat layers [4 micrometers thick] were coated on three of the photoconductor drum photoreceptors of Example I using a Tsugiage ring coater and dried at 118° C. for 30 minutes.

EXAMPLE V

Elvamide 8063 (from the E.I. Du Pont de Nemours Co.) [4 grams], methanol [20 grams] and 1-propanol [20 grams] were combined in an 8 ounce amber bottle and warmed with magnetic stirring in a water bath at about 60° C. After a solution formed, the clear mixture was then allowed to cool to 25° C. and N,N'-diphenyl-N,N'-bis(3-hydroxyphenyl)-1,1'-biphenyl-4,4'-diamine (DHTBD) [3.6 grams] was added and stirred until a complete solution was effected. Steel shot [500 grams] and Black Pearls carbon [0.25 grams] were added to the polymer solution and milled for 48 hours. The milled solution was passed through a Nitex filter [24 micrometers] to capture the steel shot and any large particulates. Oxalic acid [0.4 gram] and hexamethoxymethylmelamine [0.3 gram] were added and the mixture was warmed to 40° C.–50° C. until a solution formed. The solution was allowed to set overnight to ensure mature viscosity properties. Overcoat layers [4 micrometers thick] were coated on three of the photoconductor drum photoreceptors of Example I using a Tsugiage ring coater and dried at 118° C. for 30 minutes.

EXAMPLE VI

Drum photoreceptors of Example I (without the overcoat) and drum photoreceptors of Examples II, III and IV were first tested for xerographic sensitivity and cyclic stability. Each photoreceptor device was mounted on a shaft of a scanner. Each photoreceptor was charged by a corotron mounted along the periphery of the drum. The surface potential was measured as a function of time by capacitively coupled voltage probes placed at different locations around the shaft. The probes were calibrated by applying known potentials to the drum substrate. The photoreceptor on the drum was exposed by a light source located at a position near the drum downstream from the corotron. As the drum was rotated, the initial (pre-exposure) charging potential was measured by voltage probe 1. Further rotation leads to the exposure station, where the photoreceptor was exposed to monochromatic radiation of a known intensity. The photoreceptor was erased by light source located at a position upstream of charging. The measurements made included charging of the photoreceptor in a constant current or voltage mode. The photoreceptor was corona charged to a negative polarity. As the drum was rotated, the initial charging potential was measured by voltage probe 1. Further rotation lead to the exposure station, where the photoreceptor was exposed to monochromatic radiation of known intensity. The surface potential after exposure was measured by voltage probes 2 and 3. The photoreceptor was finally exposed to an erase lamp of appropriate intensity and any residual potential was measured by voltage probe 4. The process was repeated with the magnitude of the exposure automatically changed during the next cycle. The photodischarge characteristics (PIDC) were obtained by plotting the potentials at voltage probes 2 and 3 as a function of light exposure. The charge acceptance and dark decay were also measured in the scanner. There were no significant differences in the PIDC shape or sensitivity in the four devices. This indicates that the corona placed charges on the free surface of the overcoat have effectively been transferred to the interface between the transport layer and overcoat layer before the exposure step. On cycling for 10000 cycles, the devices were found to be stable.

EXAMPLE VII

The overcoat layers of photoreceptor drums of Examples II, III and IV were tested for cross-linking by rubbing the overcoat layers with Q tips soaked in methanol. The integrity of the layers were maintained after several hard rubs which indicates that the overcoats had cross linked.

EXAMPLE VII

An unovercoated drum of Example I and overcoated drums of Examples II, III and IV were tested in a wear fixture that contained a bias charging roll for charging. Wear was calculated in terms of nanometers/kilocycles of rotation (nm/Kc). Reproducibility of calibration standards was about ±2 nm/Kc. The wear of the drum without the overcoat of Example I was greater than 80 nm/Kc. Wear of the overcoated drums of this invention of Examples II, III and IV was ~20 nm/Kc. Thus, the improvement in resistance to wear for the photoreceptor of this invention, when subjected to bias charging roll cycling conditions, was very significant.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a photoconductive layer and a partially electrically conductive overcoat layer comprising finely divided charge injection enabling particles dispersed in a charge transporting continuous matrix comprising a cross linked polyamide, charge transport molecules and oxidized charge transport molecules, the continuous matrix being formed from a solution selected from the group consisting of a first solution comprising crosslinkable alcohol soluble polyamide containing methoxy methyl groups attached to amide nitrogen atoms, an acid having a $pK_a$ of less than about 3, a cross linking agent selected from the group consisting of a formaledhyde generating cross linking agent, an alkoxylated cross linking agent, a methylolamine cross linking agent and mixtures thereof, a dihydroxy arylamine, and a liquid selected from the group consisting of alcohol solvents, diluent, and mixtures thereof, and a second solution comprising crosslinkable alcohol soluble polyamide free of methoxy methyl groups attached to amide nitrogen atoms, an acid having a $pK_a$ of less than about 3, a crosslinking agent selected from the group consisting of an alkoxylated cross linking agent, a methylolamine cross linking agent and mixtures thereof, a dihydroxy arylamine, and a liquid selected from the group consisting of alcohol solvents, diluent, and mixtures thereof.

2. An electrophotographic imaging member according to claim 1 wherein the hydroxy arylamine is N,N'-diphenyl-N,N'-bis(3-hydroxyphenyl)-[1,1'-biphenyl]-4,4'-diamine.

3. An electrophotographic imaging member according to claim 1 wherein the charge injection particles comprise carbon.

4. An electrophotographic imaging member according to claim 1 wherein the charge injection particles comprise tin oxide.

5. An electrophotographic imaging member according to claim 1 wherein the crosslinkable alcohol soluble polyamide containing methoxy methyl groups attached to amide nitrogen atoms is selected from the group consisting of materials represented by the following formulae I and II:

I

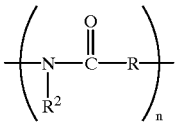

wherein:

n is a positive integer,

R is independently selected from the group consisting of alkylene, arylene and alkarylene units, between 1 and 99 percent of the $R^2$ sites are —H, and the remainder of the $R^2$ sites are $—CH_2—O—CH_3$, and wherein:

II

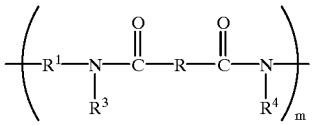

m is a positive integer,

R' and R are independently selected from the group consisting of alkylene, arylene and alkarylene units, between 1 and 99 percent of the $R^3$ and $R^4$ sites are —H, and the remainder of the $R^3$ and $R^4$sites are $—CH_2—O—CH_3$.

6. An electrophotographic imaging member according to claim 1 wherein the rosslinkable alcohol soluble polyamide free of methoxy methyl groups attached to amide nitrogen atoms is represented by the following formula:

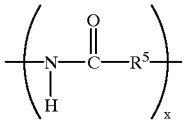

wherein:

x is a positive integer, $R^5$ is independently selected from the group consisting of alkylene, arylene and alkarylene units, or the following formula

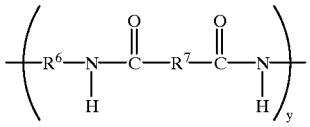

wherein:

y is a positive integer, and $R^6$ and $R^7$ are independently selected from the group consisting of alkylene, arylene and alkarylene units.

7. An electrophotographic imaging member according to claim 1 wherein the charge transport molecules comprise dihydroxy arylamine represented by the formula:

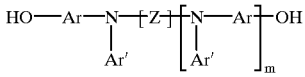

wherein m is 0 or 1,

Z is selected from the group consisting of:

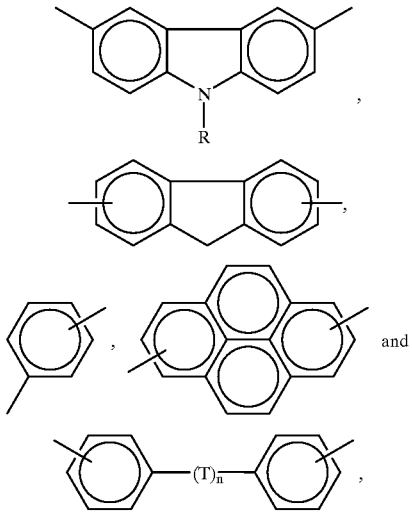

n is 0 or 1,

Ar is selected from the group consisting of:

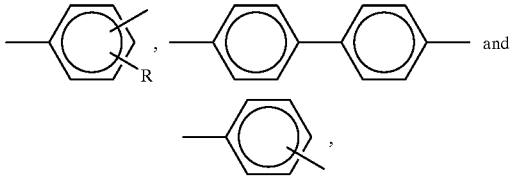

R is selected from the group consisting of —$CH_3$, —$C_2H_5$, —$C_3H_7$, and —$C_4H_9$, Ar' is selected from the group consisting of:

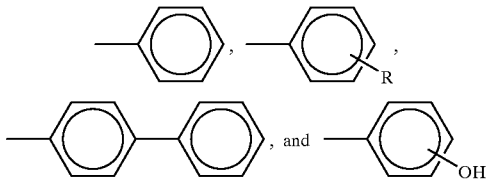

T is selected from the group consisting of:

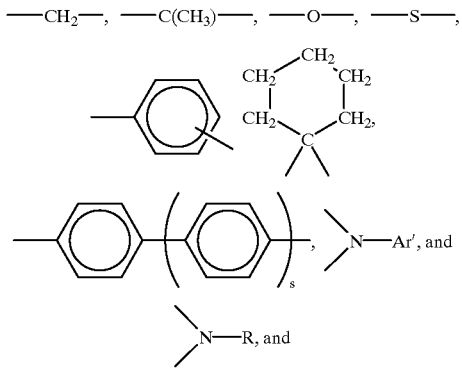

s is 0, 1 or 2.

8. An electrophotographic imaging member according to claim 1 wherein the overcoat layer comprises at least about 0.025 percent by weight of the charge injection enabling particles, based on the total weight of the overcoating layer after drying and curing.

9. An electrophotographic imaging member according to claim 8 wherein the charge injection enabling particles comprise carbon particles.

10. An electrophotographic imaging member according to claim 9 wherein the overcoat layer comprises between about 0.03 and about 0.15 percent by weight carbon particles, based on the total weight of the polyamide.

11. An electrophotographic imaging member according to claim 8 wherein the charge injection enabling particles comprise tin oxide particles.

12. An electrophotographic imaging member according to claim 11 wherein the overcoat layer comprises between about 0.2 and about 25 percent by weight tin oxide particles, based on the total weight of the polyamide.

13. An electrophotographic imaging member according to claim 1 wherein the overcoat layer has a thickness between about 1 micrometer and about 10 micrometers.

14. An electrophotographic imaging member according to claim 1 wherein the acid is oxalic acid.

15. An electrophotographic imaging member according to claim 1 wherein the acid is toluenesulfonic acid.

16. An electrophotographic imaging member according to claim 1 wherein the acid is methanesulfonic acid.

17. An electrophotographic imaging member according to claim 1 wherein the acid for both the first solution and the second solution have a $pK_a$ of between about 0 and about 3.

18. An electrophotographic imaging process comprising providing an electrophotographic imaging member having a photoconductive layer comprising a charge transport layer, and an overcoat layer, the overcoat layer having a surface which forms an interface with the transport layer and also having an exposed imaging surface, wherein the overcoat laver is a partially electrically conductive overcoat layer comprising finely divided charge iniection enabling particles dispersed in a charge transporting continuous matrix comprising a cross linked polyamide, charge transport molecules and oxidized charge transport molecules, the continuous matrix being formed from a solution selected from the group consisting of a first solution comprising crosslinkable alcohol soluble polyamide containing methoxy methyl groups attached to amide nitrogen atoms, an acid having a $pK_a$ of less than about 3, a cross linking agent selected from the group consisting of a formaledhyde generating cross linking agent. an alkoxylated cross linking agent. a methylolamine cross linking agent and mixtures thereof, a dihydroxy arylamine, and a liquid selected from the group consisting of alcohol solvents, diluent, and mixtures thereof, and a second solution comprising crosslinkable alcohol soluble polyamide free of methoxy methyl groups attached to amide nitrogen atoms, an acid having a $pK_a$ of less than about 3, a crosslinking agent selected from the group consisting of an alkoxylated cross linking agent, a methylolamine cross linking agent and mixtures thereof, a dihydroxy arylamine, and a liquid selected from the group consisting of alcohol solvents, diluent, and mixtures thereof applying a uniform negative charge to the exposed imaging surface to stimulate injection of free charges from the charge transporting matrix and free charges from the charge injecting particles into the charge transporting matrix to transport the negative charge from the imaging surface of the overcoat layer to the interface between the overcoat layer and the transport layer.

19. An electrophotographic imaging process according to claim 18 wherein the charge injection enabling particles comprise carbon particles.

20. An electrophotographic imaging process according to claim 18 wherein the overcoat layer has between about 2 CV and about 10 CV of carriers at the time the electrophotographic imaging member is charged.

21. An electrophotographic imaging process according to claim 18 including exposing the imaging member to activating radiation in image configuration to form an electrostatic latent image, developing the latent image with toner particles to form a toner image, and transferring the toner image to a receiving member.

* * * * *